US007661216B1

(12) United States Patent
Wampler

(10) Patent No.: US 7,661,216 B1
(45) Date of Patent: Feb. 16, 2010

(54) ILLUMINATED PICTURE FRAME

(76) Inventor: Richard P. Wampler, 8 Dolphin Blvd., Ponte Vedra Beach, FL (US) 32082

( * ) Notice: Subject to any disclaimer, the term of this patent is extended or adjusted under 35 U.S.C. 154(b) by 0 days.

(21) Appl. No.: 12/287,485

(22) Filed: Oct. 9, 2008

(51) Int. Cl.
*G09F 13/18* (2006.01)

(52) U.S. Cl. ..... 40/714; 40/732

(58) Field of Classification Search ..... 40/714–716, 40/541, 732

See application file for complete search history.

(56) References Cited

U.S. PATENT DOCUMENTS

| | | | | |
|---|---|---|---|---|
| 1,480,375 | A * | 1/1924 | Cristadoro | 40/444 |
| 2,677,909 | A | 5/1954 | Heydenryk | |
| 3,742,203 | A * | 6/1973 | Noe | 40/714 |
| 4,282,669 | A | 8/1981 | Rieumont | |
| 4,989,122 | A | 1/1991 | Allekotte et al. | |
| 5,247,745 | A | 9/1993 | Valentino | |
| 5,265,357 | A | 11/1993 | Yu | |
| 5,313,724 | A | 5/1994 | Warner | |
| 7,080,918 | B2 | 7/2006 | Rowland, Jr. et al. | |
| 2004/0226209 | A1 | 11/2004 | Ayala | |

FOREIGN PATENT DOCUMENTS

| | | | |
|---|---|---|---|
| DE | 3142072 | A1 * | 5/1983 |
| DE | 102005044869 | A1 * | 4/2006 |

* cited by examiner

*Primary Examiner*—Cassandra Davis
(74) *Attorney, Agent, or Firm*—Thomas C. Saitta

(57) ABSTRACT

An illuminated picture frame or similar display device wherein direct illumination of a painting or other object is provided by light emitting diodes (LED's) mounted within the picture frame assembly, the LED's having defined light projection zones with an angle of less than 180 degrees, the frame further having a support assembly to receive the painting. The LED's are mounted in electrical communication in strips or strands facing to the rear of the frame member, with the mounting being at an angle determined by the LED defined light projection zone such that all emitted light is directed rearward or at most parallel to the plane of the painting, such that no direct light emitted by the LED's passes out of the framed area.

8 Claims, 2 Drawing Sheets

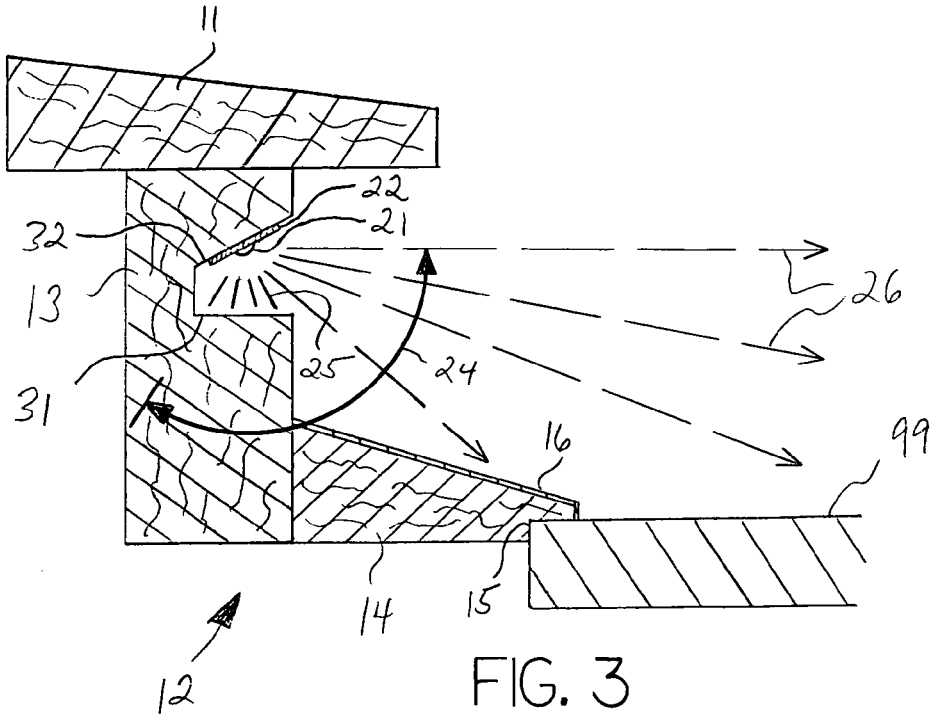
FIG. 3
FIG.4
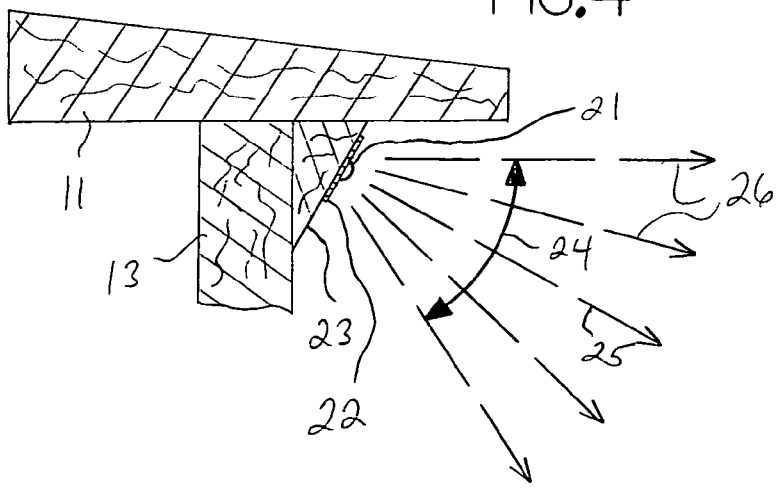

ILLUMINATED PICTURE FRAME

BACKGROUND OF THE INVENTION

This invention relates generally to the field of picture frames, display frames or shadow boxes, and more particularly to the field of such devices that are illuminated, and even more particularly to such illuminated devices wherein the lighting elements are incorporated within the frame assembly rather than externally attached.

For centuries works of art such as oil paintings have been mounted within ornamental picture frames for display and mounting, the frame retaining the canvas on which the painting is painted and presenting a decorative border with a large central opening to expose the painting. The frames range from relatively plain or extremely ornate, and are mostly composed of wood, although frames composed of metal, plastic, composite or other materials are also known. The frame is usually provided with a peripheral recess on its backside to receive the canvas supporting framework, with a portion of the backside of the frame exposed so that mounting hardware can be affixed. Likewise, it is known to provide a deeper box-like frame receptacle for displaying three-dimensional objects, which are often referred to as display frames or shadow boxes. For purposes of this application, the invention shall be described using the term picture frame, but it is to be understood that this term is used herein to represent and encompass picture frames per se, display boxes, shadow boxes and the like.

In many settings it is preferable to illuminate the painting within the picture frame, which is typically accomplished by focusing a directional light, such as a spotlight, onto the painting. The external lights may be freestanding, mounted to the wall or ceiling, or mounted onto the front of the frame itself. Such external lights are often not aesthetically pleasing, and it may be impractical to install such lights in home, office or art gallery settings. To address this issue, it is known to incorporate the lighting elements within or behind the frame, at one or preferably multiple locations about the periphery of the picture. Examples of such devices are shown in U.S. Pat. No. 2,677,909 to Heydenryk, U.S. Pat. No. 4,282,669 to Rieumont, U.S. Pat. No. 4,989,122 to Allekotte et al., U.S. Pat. No. 5,247,745 to Valentino, U.S. Pat. No. 5,265,357 to Yu, U.S. Pat. No. 5,313,724 to Warner, U.S. Pat. No. 7,080,918 to Rowland, Jr. et al., and U.S. Patent Publication No. 2004/0226209 to Ayala. In the past it was common to use incandescent or fluorescent light bulbs to illuminate the painting, but now light emitting diodes (LED's) are used in many circumstances in place of such traditional bulbs.

A shortcoming with most of the known illuminated picture frames wherein the lights are mounted within the frame is that the lights bulbs are mounted such that a portion of the light directly emitted from the bulbs escapes the frame. In order to address this issue, the frame may be provided with a relatively large overhanging face member or the interior of the frame receiving the light bulbs must be structured in relatively complicated manner, such as the frame shown in the Heydenryk patent. Another solution is to include an additional barrier member or even painting a portion of the bulb to prevent emitted light from exiting the frame.

It is an object of this invention to provide an internally illuminated picture frame wherein the emitted light is precluded from directly escaping the frame, which is achieved through the strategic placement of illuminating members, in this case LED's, having defined light projecting zones within the confines of the frame. It is a further object to provide such a device wherein almost any standard frame may be utilized, and wherein the device can be manufactured in whole or created by retrofitting existing frames.

SUMMARY OF THE INVENTION

The invention is an illuminated picture frame or similar display device wherein direct illumination of a painting or other object is provided by light emitting diodes (LED's) mounted within the picture frame assembly, the LED's having defined light projection zones of less than 180 degrees, such as for example LED's having a conical light projection zone of 120 degrees. The LED's picture frame further comprises a support assembly to receive the painting, the support assembly comprising a rectangular extension frame with a base member joined to the rear of the extension frame, the base member having a peripheral recess to receive the painting, and an ornamental or facing frame member that is connected to the front of the extension frame. The LED's are mounted in electrical communication in strips or strands on the back side of the ornamental frame member, a forward interior portion of the extension frame, or within an angled channel recess provided in the extension frame, with the mounting being at an angle determined by the LED defined light projection zone such that all emitted light is directed rearward or at most parallel to the plane of the painting, such that no direct light emitted by the LED's passes out of the framed area.

BRIEF DESCRIPTION OF THE DRAWINGS

FIG. 3 is a partial cross-sectional view of an alternative embodiment of the illuminated picture frame, showing the LED's mounted within an angular channel recess.

FIG. 4 is a partial cross-sectional view of an alternative embodiment similar to FIG. 2, showing an LED with a smaller light projection zone.

DETAILED DESCRIPTION OF THE INVENTION

With reference to the drawings, the illuminated picture frame will now be described in detail with regard for the best mode and preferred embodiment. The term "picture frame" as used herein is not meant to be limiting and is to be considered a general referencing term encompassing picture or photograph frames, display boxes, shadow boxes or the like. The term "painting" as used herein is not meant to be limiting and is to be considered a general referencing term encompassing paintings, photographs, two dimensional art work or three dimensional objects mounted for display on a backing member, or the like. Directional terms such as "forward", "rearward", "front", "back" and the like as used herein shall be taken to be in reference to the picture frame when mounted on a wall, such that "forward", "front" and the like shall be the direction away from the wall, with "rearward", "back" and the like to be taken in the opposite direction, i.e., toward the wall.

Figure 2:
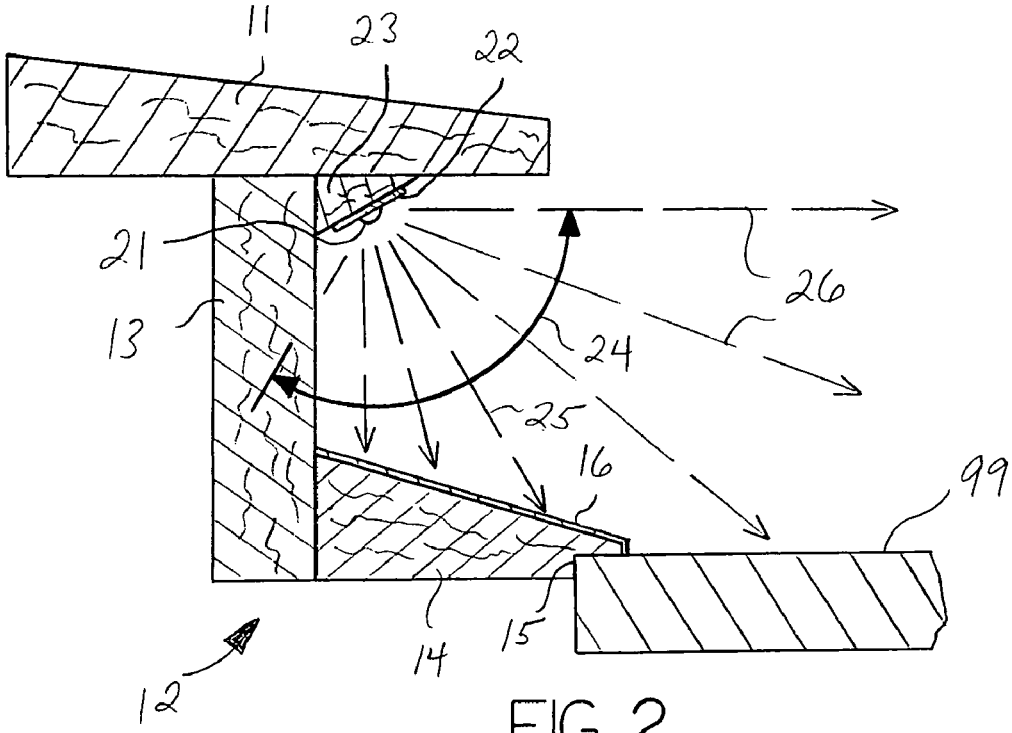
FIG. 2 is a partial cross-sectional view of the illuminated picture frame.
Figure 1:
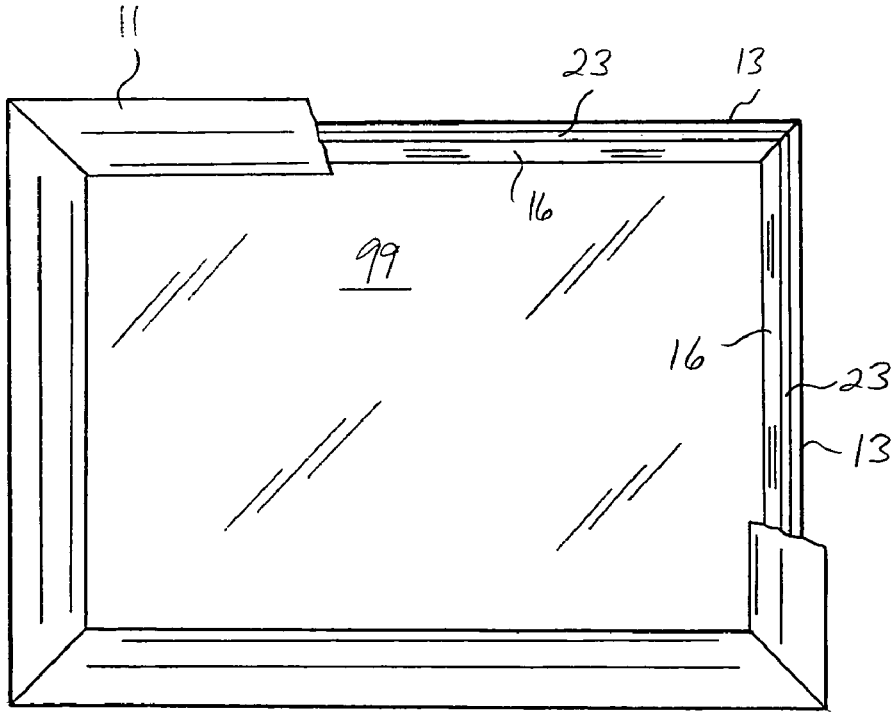
FIG. 1 is a front view of the invention with a portion of the ornamental frame cut away to expose the support assembly.

A preferred embodiment of the invention is shown in FIGS. 1, 2 and 4, wherein the illuminated picture frame comprises in general an ornamental or facing frame member 11, shown in conjunction with a painting 99. The ornamental frame member 11 is typically formed from four separate pieces joined at right angles to present a rectangular member having a large interior opening through which the painting 99 is observed, and may be composed of any suitable material such as wood, metal, plastic, composite, etc. Such ornamental frame members 11 are well known in the art. The back of the ornamental frame member 11 defines a plane parallel to the plane defined by the painting 99.

The illuminated picture frame further comprises a support assembly 12 that is the means for mounting the painting 99 within the ornamental frame member 11, the support assembly 12 comprising a rectangular extension frame 13 defining a box-like structure with an open interior, preferably formed by connecting four wall members at right angles, the dimensions of the extension frame 13 being comparable in dimensions to the ornamental frame member 11 such that the ornamental frame member 11 is mounted or connected to the front of the extension frame 13, but wherein the interior opening of the ornamental frame member 11 is smaller in dimension than the interior opening formed by the extension frame 13, such that an inner portion of the ornamental frame member 11 is a lip or extension obscuring the extension frame 13 when the illuminated picture frame is viewed directly from the front. The outer portion of the ornamental frame member 11 may extend beyond the outside of the extension frame 13, as shown, or could be sized so as to be flush. It is also possible to construct the extension frame 13 as a single rectangular member. The extension frame 13 is of greater dimension in the front to rear direction, such that the ornamental picture frame 11 is positioned a short distance away from the surface of the painting 99.

A rectangular base member 14, formed as a single or multiple piece body, is preferably joined to the rear of the extension frame 13. The base member 14 is coextensive with the painting 99, and is preferably provided with rear-facing peripheral recess 15 to receive the edges of the painting 99. Alternatively, the extension frame 13 could be provided with the rear-facing peripheral recess to receive the painting 99. The base member 14 is preferably provide with an angled front surface, which may be covered with a base covering material 16, such as a layer of paint, fabric, paper or other sheet material, preferably having a matte or generally non-reflective surface.

The picture frame is illuminated with a plurality of light emitting diodes 21 (LED's) that are positioned around the periphery of the painting 99, preferably on all four sides. Unlike traditional incandescent or fluorescent light bulbs, the direct light emitted by the LED's 21 of the invention does not cover a 360 degree projection zone. The LED's 21 are of the type having a defined light projection zone 24 of less than 180 degrees, such as for example 120 degrees, as shown in FIGS. 2 and 3, or 60 degrees, as shown in FIG. 4. The light projection zone 24 is conical in shape, such that for example for an LED 21 with a defined light projection zone 24 of 120 degrees, the light 26 will be directly projected from the LED 21 in a conical pattern centered on a perpendicular axis 25 and no direct light 26 will be projected beyond 60 degrees from that axis 25. For an LED 21 having a light projection zone 24 of 60 degrees, no direct light 26 will be projected beyond 30 degrees of the central perpendicular axis 25. The LED's 21 are presented in strips or strands 22 that contain the electrical circuitry enabling the LED's 21 to be powered using a battery, preferred, or by hard-wire connection into a standard electrical circuit, such systems being well known in the art.

The LED's 21 are mounted into the picture frame so as to face and project light rearward onto the painting 99, with the LED's 21 being mounted at an angle relative to the plane defined by the back of the ornamental frame member 11 of between zero and 90 degrees. In other words, the LED's 21 are mounted such that the perpendicular axis 25 of the light projection zone 24 lies between perpendicular and parallel to the plane of the ornamental frame member 11, with the particular angle being determined by the size of the light projection zone 24 of the LED's 21.

This is physically accomplished by mounting the LED strips 22 on an angled surface, such as angled insert member 23, as shown in FIGS. 2 and 4, or by routing a channel recess 31 into the extension frame 13, the channel recess 31 having a rearward facing angled wall 32.

The LED's 21 are mounted such that all of the projected light 26 is directed to the rear and no light 26 is directly projected out of the boundaries defined by the ornamental frame 11. Thus, for an LED 21 having a light projection zone 24 with an angle of 120 degrees, the LED 21 is mounted at an angle of 30 degrees or less relative to the plane of the ornamental frame member 11, with the LED perpendicular axis 25 being located at an angle of 60 degrees or more. In this manner, as shown in FIGS. 2 and 3, the outer edge of the light projection zone 24 does not extend beyond parallel to the plane of the ornamental frame member 11. For an LED 21 having a light projection zone 24 angle of 60 degrees, as shown in FIG. 4, the LED 21 is mounted at an angle of 60 degrees or less relative to the plane of the ornamental frame member 11, with the LED perpendicular axis 25 being located at an angle of 30 degrees or more. In mathematical terms, for an LED 21 having a given light projection zone angle of X degrees, the LED 21 is mounted such that the angle of the LED perpendicular axis 25 relative to the plane of the ornamental frame member 11 is greater than or equal to ½ X degrees.

Because of this structure, virtually any ornamental frame 11 may be utilized as a component of the illuminated picture frame as described herein, thereby allowing the consumer to choose from the hundreds of thousands of frames now in production. When in use, the painting 99 is directly illuminated by the LED's 21 disposed around the periphery, while no light is projected directly from the LED's 21 out of the front of the painting.

It is contemplated that equivalents and substitutions for certain elements set forth and described above may be obvious to those skilled in the art, and therefore the true scope and definition of the invention is to be as set forth in the following appended claims.

I claim:

1. An illuminated picture frame comprising:

an ornamental frame member mounted onto a support assembly adapted to receive a painting, said support assembly comprising a rectangular extension frame member, and said ornamental frame member defining a plane;

a plurality of LED's mounted behind said ornamental frame member, each said LED having a defined light projection zone comprising a conical zone centered upon an axis perpendicular to said LED, said defined light projection zone having an angle of less than 180 degrees;

said picture frame further comprising an wedged shaped insert member mounted to either said ornamental frame member or said extension member, wherein said LED's are mounted onto said wedged shaped insert member;

wherein said LED's are mounted behind said ornamental picture frame such that direct light emitted from said LED's is directed rearward and does not pass through said plane.

2. The frame of claim 1, said support system further comprising a base member connected to the rear of said extension frame member, and wherein said base member is adapted to receive said painting.

3. The frame of claim 2, further comprising a base covering material disposed on said base member.

4. An illuminated picture frame comprising:

an ornamental frame member mounted onto a support assembly adapted to receive a painting, said support assembly comprising a rectangular extension frame member, and said ornamental frame member defining a plane;

a plurality of LED's mounted behind said ornamental frame member, each said LED having a defined light projection zone comprising a conical zone centered upon an axis perpendicular to said LED, said defined light projection zone having an angle of less than 180 degrees;

said picture frame further comprising a channel recess located in said extension member, said channel recess having an angled wall and said LED's mounted onto said angled wall;

wherein said LED's are mounted behind said ornamental picture frame such that direct light emitted from said LED's is directed rearward and does not pass through said plane.

5. The frame of claim 4, said support system further comprising a base member connected to the rear of said extension frame member, and wherein said base member is adapted to receive said painting.

6. The frame of claim 5, further comprising a base covering material disposed on said base member.

7. An illuminated picture frame comprising:

an ornamental frame member mounted onto a support assembly adapted to receive a painting, said support assembly comprising a rectangular extension frame member, a rectangular base member joined to the rear of said extension frame member, and angled insert members mounted toward the front of said extension frame member and to the rear of said ornamental frame member;

said ornamental frame member defining a plane;

a plurality of LED's positioned on mounting strips and mounted on said angled insert members, each said LED having a defined light projection zone comprising a conical zone centered upon an axis perpendicular to said LED, said defined light projection zone having an angle of less than 180 degrees;

wherein said LED's are mounted behind said ornamental picture frame such that said LED perpendicular axis is directed rearward and such that the angle of said LED perpendicular axis relative to said plane of said ornamental frame member is greater than or equal to one half of the angle of said defined light projection zone, whereby no direct light emitted form said LED's passes through said plane.

8. The frame of claim 7, further comprising a base covering material disposed on said base member.

* * * * *